US005139848A

United States Patent [19]

Grafen et al.

[11] Patent Number: 5,139,848

[45] Date of Patent: Aug. 18, 1992

[54] ANTI-FRICTION COMBINATION SECTION WITH DIFFERENTIAL EXPANSION MEANS

[75] Inventors: Karl Grafen, Wurselen; Hans Cramer, Aachen, both of Fed. Rep. of Germany

[73] Assignee: H. Krantz GmbH & Co., Aachen, Fed. Rep. of Germany

[21] Appl. No.: 645,781

[22] Filed: Jan. 25, 1991

[30] Foreign Application Priority Data

Feb. 3, 1990 [DE] Fed. Rep. of Germany ... 9001227[U]

[51] Int. Cl.[5] ..... D06C 3/00; B32B 3/10

[52] U.S. Cl. ..... 428/138; 428/166; 428/135; 428/136; 428/134; 428/192; 428/457; 384/9; 384/905; 26/91

[58] Field of Search ..... 428/166, 138, 135, 136, 428/134, 192, 457; 384/9, 905; 26/91

[56] References Cited

U.S. PATENT DOCUMENTS

| | | | |
|---|---|---|---|
| 1,433,077 | 10/1922 | Hansen | 428/136 |
| 2,378,343 | 6/1945 | Walter | 384/9 |
| 2,556,071 | 6/1951 | Denton | 428/138 |
| 2,653,889 | 9/1953 | Hager et al. | 428/138 |
| 3,655,501 | 4/1972 | Tesch | 428/136 |
| 3,896,247 | 7/1975 | Descleve et al. | 428/136 X |
| 4,563,374 | 1/1986 | Treber et al. | 428/167 |
| 4,848,935 | 7/1989 | Seibig et al. | 384/905 |

FOREIGN PATENT DOCUMENTS

| | | | |
|---|---|---|---|
| 1417244 | 12/1975 | United Kingdom | 384/905 |

*Primary Examiner*—Ellis P. Robinson
*Assistant Examiner*—William P. Watkins, III
*Attorney, Agent, or Firm*—Mark T. Basseches

[57] ABSTRACT

A combination section consisting of a base section (1) and a covering section (2). The covering section (2) is of an anti-friction material having a coefficient of expansion deviating from that of the material of the base section (1), and is divided between fastening points into partial lengths (4). The partial lengths (4) are interconnected by deformable bridges (6). This makes it possible for the partial lengths (4) to expand essentially unhindered, independent of the expansion of the base section (1) to a different extent.

5 Claims, 1 Drawing Sheet

ANTI-FRICTION COMBINATION SECTION WITH DIFFERENTIAL EXPANSION MEANS

BACKGROUND AND FIELD OF THE INVENTION

This invention relates to a combination section consisting of a base section and of a covering section fastened thereto at intervals over the length of the section and made of a material of low frictional resistance, i.e. to serve as a guide rail, chain support or the like.

PRIOR ART

Such combination sections are generally known and serve, for example, as guide rails for slide chains in a tenter drier to take up the chain weight and the force resulting from tentering the merchandise width. In order to assure low frictional resistance between sliding chain and guide rail, the materials used for covering sections are composite materials screwed or riveted to a steel strip as base section. This connection between base section and covering section requires per se that both sections be made of materials having the same coefficient of thermal expansion. In composite materials heretofore known for the covering section a coefficient of expansion corresponding to that of the steel strip as base section is achievable only if asbestos or glass fabric is inserted in the composite material. Both insertions have fundamental disadvantages. For instance, asbestos is known to be extremely dangerous environmentally and glass fabric promotes steel wear because it is harder than steel.

The invention is based on the task of providing a combination section in which the covering section consists of a material which requires no asbestos or glass fabric insertion, yet does not permit inadmissible stresses on the one or the other section to originate due to differential expansion.

SUMMARY OF THE INVENTION

The solution proposed by the present invention is to form a combination section by fixing at spaced connection points to a base section, an anti-friction cover section of material having a differential coefficient of expansion from the base section, the cover section being characterized by the formation of longitudinally expansible and contractible bridges disposed between said connection points.

Due to the inventive division of the covering section between fastening points into partial lengths connected to each other by deformable bridges, the partial lengths can essentially expand or contract unhindered, independent of the expansion of the base section to a different extent.

According to one embodiment of the invention, each deformable bridge is defined by two relatively closely spaced transverse slots mutually staggered in the longitudinal direction and extending from opposite sides of the covering section. The slots extend across a major portion of the width of the covering section.

Due to this design, the partial lengths of the covering section can expand more than the base section by about the width of the slots without being overstressed.

According to another embodiment of the invention, each deformable bridge may also be formed of two connecting webs arranged in mirror image to each other and defining a parallelogram having opposed acute angles aligned with the length and obtuse angles facing transversely of the covering section.

Finally, the possibility also exists to interconnect the partial lengths of the covering section by a number of webs of zig-zag, arched or meandering shape.

BRIEF DESCRIPTION OF THE DRAWINGS

Three embodiment examples of a combination section according to the invention are shown as partial lengths in the drawings, namely FIG. 1 a top plan view of a combination section provided with cut-ins perpendicular to the longitudinal direction of the covering section.

In the embodiment examples, the combination section is provided throughout with a base section 1 to which is fastened a covering section 2 by means of rivets 3 arranged at regular intervals over the length of the section.

Figure 1:
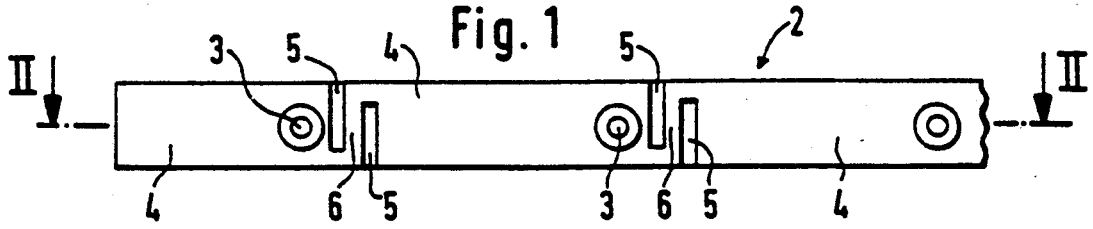
Figure 2:
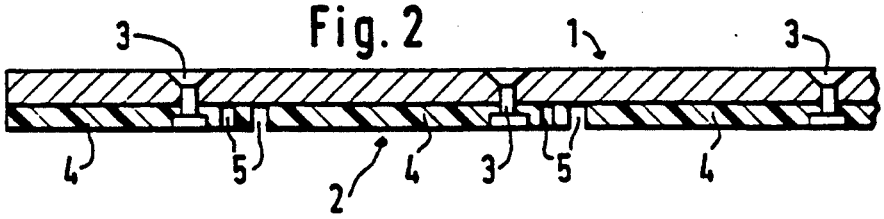
FIG. 2 a vertical section of the combination section along line II—II of FIG. 1.

In the section combination according to FIGS. 1 and 2, the covering section 2 consists of partial lengths 4, each being delimited by cut-ins or slots 5 which start perpendicularly from opposite sides and are mutually staggered, and forming bridges 6.

Figure 3:
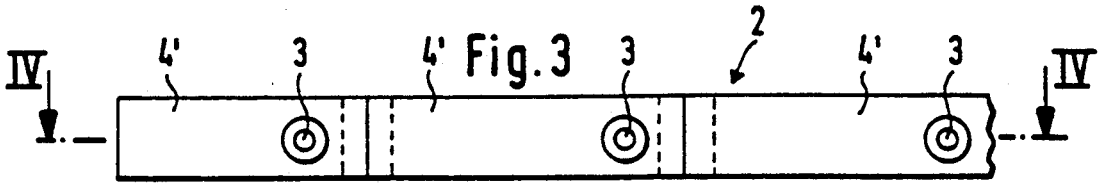
FIG. 3 a top view of an embodiment of the combination section with partial lengths of the covering section, interconnected by bridges reduced in cross-sectional thickness.
Figure 4:
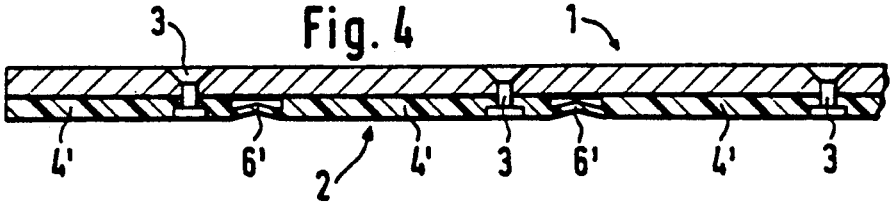
FIG. 4 a vertical section of the combination section along line IV—IV of FIG. 3.

In the section combination according to FIGS. 3 and 4, the covering section 2 consists of partial lengths 4', each forming bridges 6' due to the reduction of the material thickness of the covering section 2. These bridges are bent into a cavity between the covering section 2 and the base section 1 resulting from the material thickness reduction.

Figure 5:
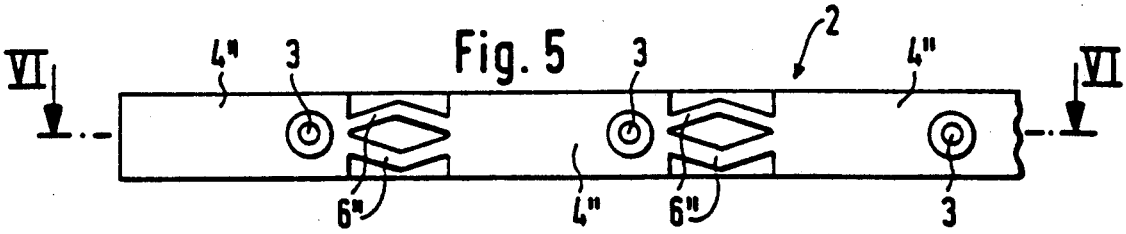
FIG. 5 a top view of a further embodiment of a combination section in which the bridges between the partial lengths of the covering section are formed by connecting webs defining parallelograms.
Figure 6:
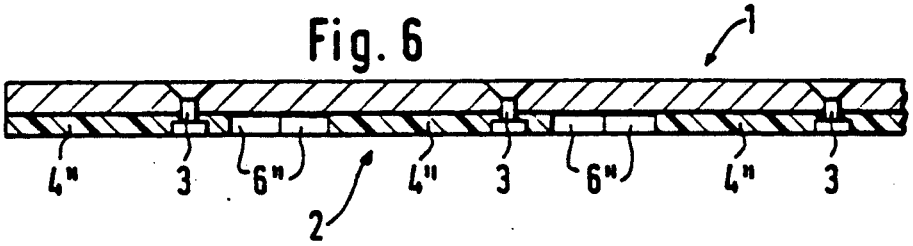
FIG. 6 a vertical section of the combination section along line VI—VI of FIG. 5.

In the section combination according to FIGS. 5 and 6, the covering section 2 consists of partial lengths 4'', each interconnected by bridges 6'' formed of connecting webs. These connecting webs are angled in the plane of the covering section divergently such that each pair of them forms a parallelogram having acute angles aligned with the length of the section and obtuse angles directed transversely of the section.

In all instances a fastening is effected between the base section and each partial section. Likewise, in all instances the ability of the bridges to expand and contract by expansion and contraction of the bridges enables the two materials having different coefficients of expansion to be united without distortion.

Numerous variations in details of construction will occur to skilled workers familiarized with this disclosure and hence the invention should be broadly construed within the scope of the appended claims.

We claim:

1. A guide rail combination section for slide chains in a tender drier comprising an elongate rigid base section and an elongate integral cover section of anti-friction material having a coefficient of thermal expansion differing from the material of the base section, a plurality of fastening means immoveably connecting said base and cover sections at positions offset lengthwise from each other, increments of said cover section between said fastening means being removed to define bridges deformable in the lengthwise direction of said cover section, whereby differential expansion of said sections is accommodated by deformation of said bridges.

2. A combination section in accordance with claim 1, wherein said bridges are defined by first and second slots mutually staggered in the longitudinal direction of said covering sections, each said slot emanating from an opposite longitudinal edge of said cover section from the other slot and extending across the major portion of the width of said cover section.

3. A combination section in accordance with claim 2, wherein said slots are directed perpendicularly relative to the longitudinal axis of said cover section.

4. A combination section in accordance with claim 1, wherein said bridges are comprised of four connecting webs of said cover section, said webs defining a parallelogram having opposed acute angles whose apices are aligned with the longitudinal axis of said cover section and opposed obtuse angles directed transversely of the longitudinal axis of said cover section.

5. A combination section in accordance with claim 1, wherein said removed increments extend transversely entirely across and partway through the thickness of said cover section, and are arched in a plane perpendicular to the plane of said cover section.

* * * * *